US009422656B2

(12) United States Patent
Lee et al.

(10) Patent No.: US 9,422,656 B2
(45) Date of Patent: Aug. 23, 2016

(54) DRUM TYPE WASHING MACHINE

(71) Applicant: Dongbu Daewoo Electronics Corporation, Seoul (KR)

(72) Inventors: Ju Dong Lee, Seoul (KR); Jeong Hyeon Kim, Seoul (KR); In Dong Kim, Seoul (KR); Hye Ung Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 253 days.

(21) Appl. No.: 14/167,923

(22) Filed: Jan. 29, 2014

(65) Prior Publication Data

US 2015/0176169 A1 Jun. 25, 2015

(30) Foreign Application Priority Data

Dec. 24, 2013 (KR) ..... 10-2013-0163094

(51) Int. Cl.

| | |
|---|---|
| ***D06F 31/00*** | (2006.01) |
| ***D06F 29/00*** | (2006.01) |
| ***D06F 37/30*** | (2006.01) |

(52) U.S. Cl.

CPC ..... *D06F 31/00* (2013.01); *D06F 29/00* (2013.01); *D06F 37/30* (2013.01)

(58) Field of Classification Search

CPC ..... D06F 31/00; D06F 29/00; D06F 37/30
USPC ..... 68/27
See application file for complete search history.

(56) References Cited

U.S. PATENT DOCUMENTS

| | | | | |
|---|---|---|---|---|
| 2,219,680 | A * | 10/1940 | Caldwell | D06F 13/02 68/133 |
| 2,816,429 | A * | 12/1957 | Kurlancheek | D06F 29/00 68/139 |
| 2,834,121 | A * | 5/1958 | Geldhof | D06F 29/00 34/596 |
| 2,871,688 | A * | 2/1959 | Geldhof | D06F 29/00 34/90 |
| 2,887,354 | A * | 5/1959 | Lichtenstein et al. | D06F 43/04 68/152 |
| 3,035,430 | A * | 5/1962 | Rothenberger | D06F 21/04 68/27 |
| 3,555,701 | A * | 1/1971 | Hubbard | D06F 58/02 34/602 |
| 7,404,303 | B1 * | 7/2008 | Barbosa | D06F 29/00 68/19.2 |

FOREIGN PATENT DOCUMENTS

| | | |
|---|---|---|
| KR | 20040006683 | 1/2004 |
| KR | 1020130163094 | 7/2015 |

* cited by examiner

*Primary Examiner* — Joseph L Perrin

(57) ABSTRACT

A drum type washing machine includes a main tub having a main drum that rotates to wash laundry, a sub tub separate from the main tub and having a sub drum that rotates to wash laundry, and a clutch unit including a motor that provides a rotational force to at least one of the main drum and the sub drum.

11 Claims, 4 Drawing Sheets

DRUM TYPE WASHING MACHINE

CROSS-REFERENCE TO RELATED APPLICATIONS

This application is based on and claims priority from Korean Patent Application No. 10-2013-0163094, filed on Dec. 24, 2013, the disclosure of which is incorporated herein in its entirety by reference.

TECHNICAL FIELD

The present disclosure relates to a washing machine, and more particularly, to a drum type washing machine having a separate sub tub and drum, which is able to wash baby clothes separately from other clothes and laundry, thereby preventing contamination of the baby clothes by adult or other clothes or laundry, or by detergent and/or fabric softener used to wash the adult or other clothes or laundry.

BACKGROUND

In general, a drum type washing machine is designed to put laundry into the washing machine through a door at a front side of the washing machine, and to wash the laundry using a relatively small amount of water and detergent. The drum type washing machine typically includes single drum that receives and holds laundry for washing.

In general, households where the washing machine is used usually own the laundry being washed, including adult clothes and sometimes baby clothes. Thus, it is conventional in a household having a single washing machine that the adult clothes and baby clothes are washed in the single drum.

However, in the case where the adult clothes and baby clothes are washed in the single drum of the washing machine, the drum may be contaminated by bacteria, relatively harsh detergents, chemicals in fabric softener and bleach, and the like, as a result of washing the adult clothes. Thus, the baby clothes may be exposed to such contaminants, and become contaminated by the bacteria and the like.

In order to prevent this situation, two or more washing machines should be purchased, but it is generally not desirable or economical.

SUMMARY

Embodiments of the present disclosure provide a drum type washing machine which can prevent baby clothes from becoming contaminated by contaminants resulting from washing adult clothes.

Exemplary embodiments of the present disclosure provide a drum type washing machine comprising a main tub having a main drum that rotates to wash main laundry, a sub tub separate from the main tub and having a sub drum that rotates to wash separate laundry, and a clutch unit including a motor configured to provide a rotational force to at least one of the main drum and the sub drum.

The clutch unit may comprise a driving part connected to the motor; and a power transfer assembly connected to the driving part and selectively connectable to the main drum and/or the sub drum. When the power transfer assembly is connected to the driving part, the rotational force of the motor is transferred to the drum connected to the power transfer assembly. In some embodiments, the driving part and the power transfer assembly exists in two sets in the clutch unit, in which the two power transfer assemblies may be respectively connected to the main drum and the sub drum. For example, the clutch unit may comprise a first driving part connected to the motor, a first power transfer assembly connected to the main drum and selectively connectable to the first driving part, a second driving part connected to the motor, and a second power transfer assembly connected to the sub drum and selectively connectable to the second driving part.

The driving part and the power transfer assembly may be selectively connected by a clutch structure comprising a clutch cover and a clutch disc that selectively engage with each other. In other words, the clutch unit may comprise a clutch cover and a clutch disc that selectively engage or interface with each other, to transfer the rotational power from the motor to one of the main drum and the sub drum.

The power transfer assembly may comprise a transfer shaft that is movable in a first direction approaching the driving part and a second direction moving away from the driving part, a pulley shaft selectively connectable to the transfer shaft, an inner pulley connected to the pulley shaft and transferring rotation of the pulley shaft to one of the main drum and the sub drum, and a cylinder configured to move the transfer shaft in the first and second directions. In various embodiments, the pulley shaft is connected to the transfer shaft when the transfer shaft is engaged with the driving part. Conversely, the pulley shaft is disconnected from the transfer shaft when the transfer shaft is disengaged from the driving part. The inner pulley may be at or proximate to an end of the pulley shaft opposite to the driving part. The power transfer assembly may further comprise a connector connected to the transfer shaft and the cylinder, configured to transfer translational power from the cylinder to the transfer shaft, and allow rotation of the transfer shaft.

According to embodiments of the present disclosure, since it is possible to wash baby clothes and adult clothes in separate drums, contamination of the baby clothes from contaminants associated with washing the adult clothes may be avoided or prevented.

DETAILED DESCRIPTION

Figure 1:
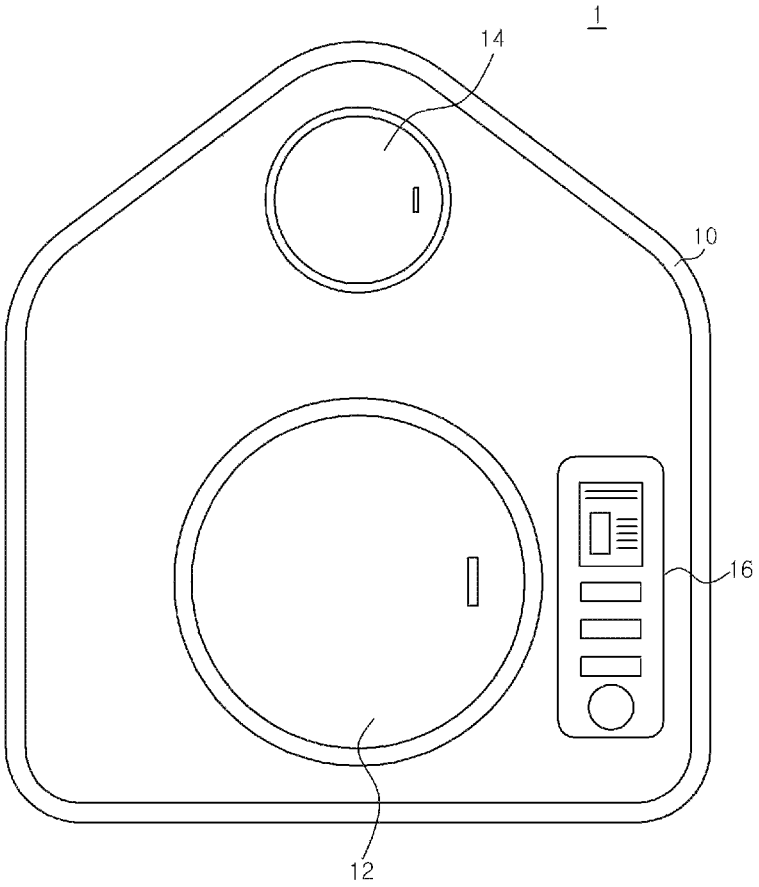
FIG. 1 is a front view of an exemplary drum type washing machine according to one or more embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and may not be necessarily dimensionally illustrated or accurate. Relative sizes and proportions of parts in the drawings may be exaggerated or reduced in their sizes, and a predetermined size is exemplary, and not limiting. The same reference numerals designate the same structures, elements, or parts illustrated in two or more drawings in order to exhibit the same or similar characteristics.

The disclosed embodiments illustrate idealized exemplary embodiments of the present disclosure in detail. As a result, various modifications of the drawings are expected. Accordingly, the exemplary embodiments are not limited to a specific form or illustrated region, and for example, include modifications of form by manufacturing.

Hereinafter, exemplary embodiments will be described in detail with reference to the accompanying drawings.

Figure 2:
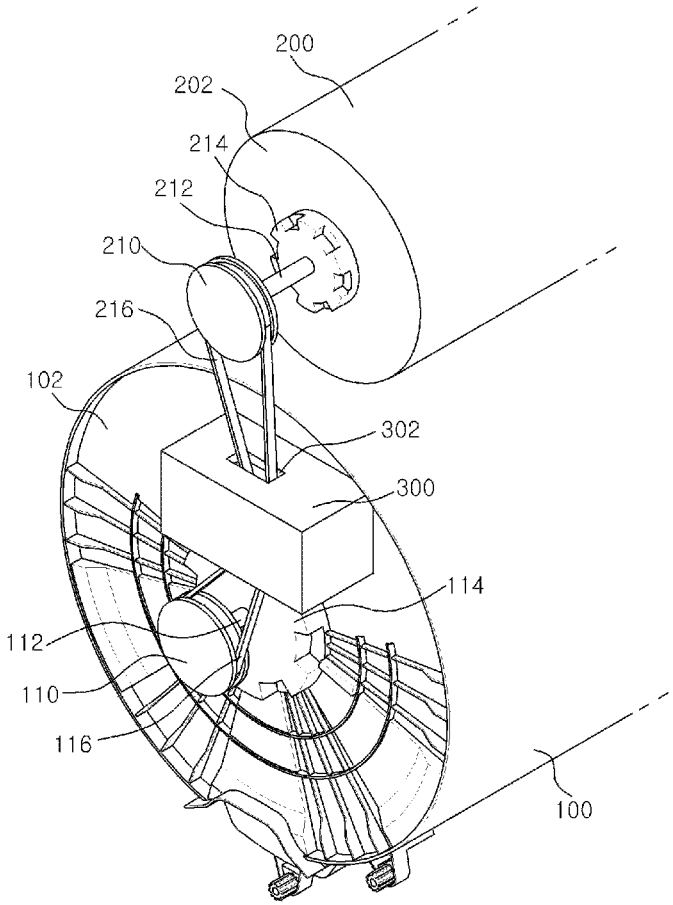
FIG. 2 is a schematic view illustrating an exemplary connection structure between a motor unit and each of a main tub and a sub tub in the exemplary drum type washing machine of FIG. 1.

FIG. 1 is a front view of an exemplary drum type washing machine according to one or more embodiments of the present disclosure, and FIG. 2 is a schematic view illustrating an exemplary connection structure between a motor unit and each of a main tub and a sub tub in the exemplary drum type washing machine of FIG. 1.

Referring to FIG. 1 and FIG. 2, a drum type washing machine 1 according to exemplary embodiment(s) of the present disclosure includes two tubs 100, 200 inside a cabinet 10 forming an exterior of the washing machine 1, and the two tubs 100, 200 are opened and closed by a main door 12 and a sub door 14, respectively.

Laundry washed by the drum type washing machine 1 may be classified into a first or main laundry, such as adult clothes having a relatively large amount of bacteria and that are washed with relatively strong detergents and fabric softener, and a second or sub laundry, such as baby clothes having a relatively small amount of bacteria and that are washed with relatively mild detergent and generally no fabric softener. However, the above classification is only one example, and the present disclosure is not limited by the kinds of clothing or laundry washed by the drum type washing machine 1.

A main tub 100 connected to the main door 12 may be used in washing the first or main laundry, and the sub tub 200 connected to the sub door 14 may be used in washing the second or sub laundry. Operations of the drum type washing machine 1 may be controlled by a control panel 16, which may be connected to a controller (not illustrated) inside the cabinet 10. One or more washing operations using at least one of the main tub 100 and the sub tub 200 can be performed by manipulating the control panel 16. In general, the control panel 16 controls (e.g., allows the user to select) multiple washing operations (e.g., washing, rinsing, spin-drying, and/or drying) and/or settings thereof (e.g., default settings for laundry types such as regular laundry, delicate laundry, permanent press or wool clothing, etc., or selectable settings such as time, temperature and/or rotation rate for a particular operation) for each of the main tub 100 and the sub tub 200.

Each of the main tub 100 and the sub tub 200 includes a drum (not illustrated) in which the laundry is placed. The washing operation is performed by rotating the drum. The drums inside each of the tubs 100 and 200 may be selectively rotated by a motor controlled by the controller. In the present embodiment, the drum inside the main tub 100 is called a 'main drum' and the drum inside the sub tub 200 is called a 'sub drum'.

The main drum is connected to a main shaft 112 supported by a main supporting member 114 fixed or attached to the main tub 100. The main shaft 112 extends or protrudes from a rear surface 102 of the main tub 100, and a main pulley 110 is connected to the protruding end of the main shaft 112. The main supporting member 114 may be connected to the main shaft 112 through a bearing or the like to allow the main shaft 112 to rotate in the main supporting member 114, and the main drum connected to the main shaft 112 also rotates in the main tub 100.

Like the main drum, the sub drum is also connected to a sub shaft 212 supported by a sub supporting member 214. The sub shaft 212 extends or protrudes from a rear surface 202 of the sub tub 200, and a sub pulley 210 is connected to the protruding end of the sub shaft 212. The sub supporting member 214 may be connected to the sub shaft 212 through a bearing or the like to allow the sub shaft 212 to rotate in the sub supporting member 214, and the sub drum connected to the sub shaft 212 also rotates in the sub tub 200.

A clutch unit 300 is behind and/or at a rear side of the main tub 100 and the sub tub 200, and the main pulley 110 and the sub pulley 210 are respectively connected to two inner pulleys (see 337 in FIG. 3) inside the clutch unit 300 by a main belt 116 and a sub belt 216. When the inner pulley 337 of the clutch unit 300 rotates, the main pulley 110 or the sub pulley 210 connected to the rotating inner pulley 337 rotates too. Holes or openings 302 allowing the main belt 116 and the sub belt 216 to pass through are in surfaces (e.g., top and bottom surfaces) of the housing of the clutch unit 300.

The clutch unit 300 is electrically connected to the controller, and may be operated to rotate one or both of the main pulley 110 and the sub pulley 210 according to a control signal from the controller.

Figure 3:
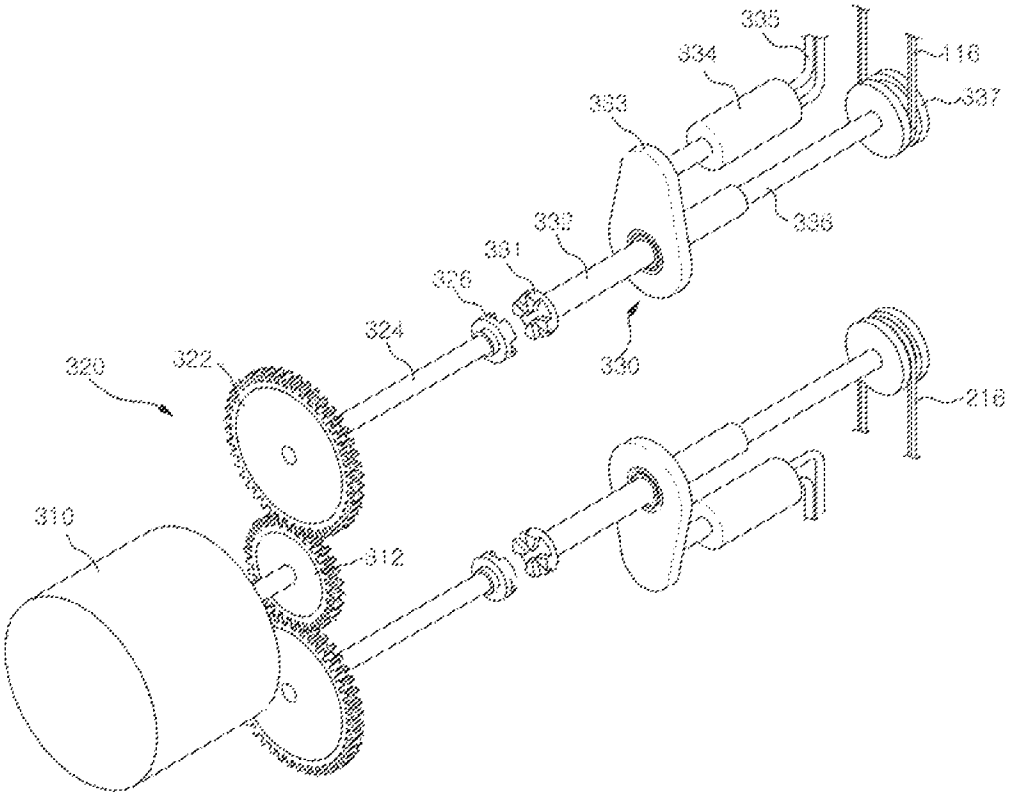
FIG. 3 is a perspective view illustrating an exemplary connection structure of various parts inside an exemplary clutch unit in the exemplary motor unit of FIG. 2.
Figure 4:
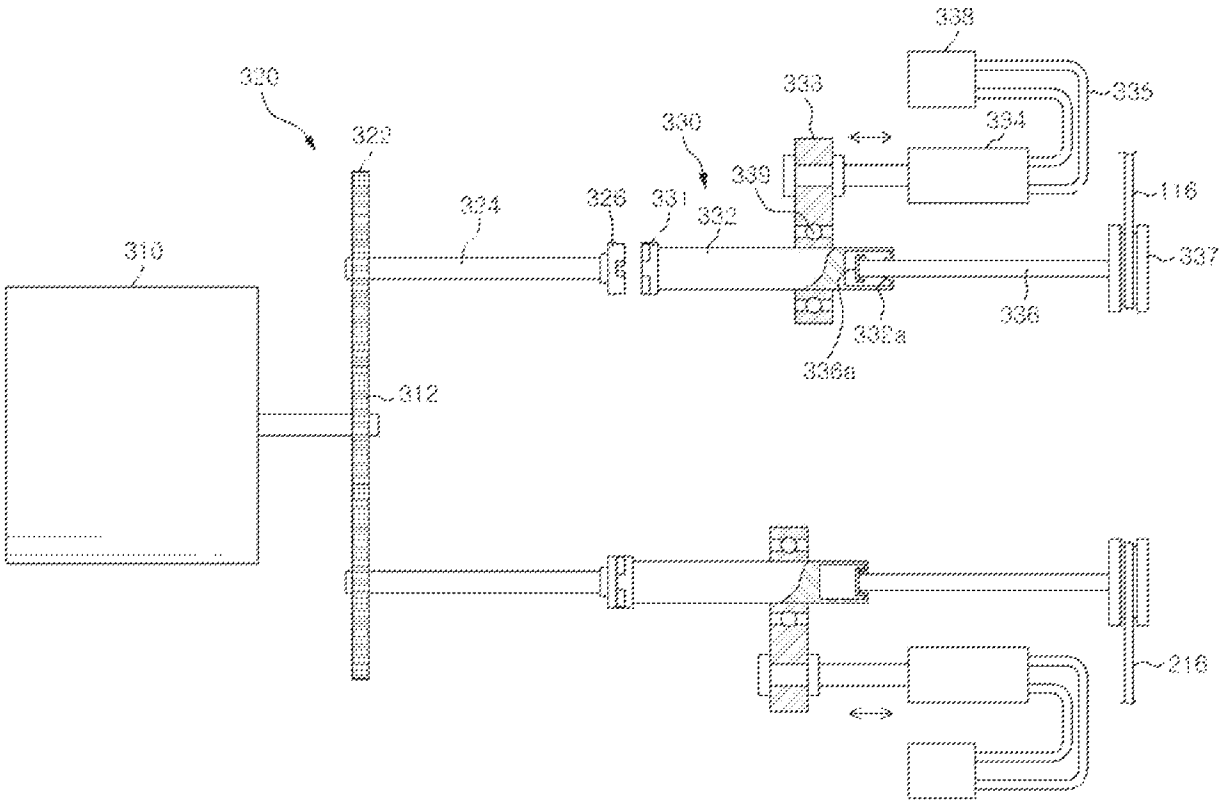
FIG. 4 is a schematic and/or side view of the exemplary clutch unit of FIG. 3, for explaining operations of various parts in the clutch unit.

An exemplary detailed configuration of the clutch unit 300 is illustrated in FIGS. 3 and 4.

FIG. 3 is a perspective view illustrating an exemplary connection structure of various parts inside an exemplary clutch unit suitable for use in the exemplary main tub-sub tub-motor unit of FIG. 2, and FIG. 4 is a schematic and/or side view for explaining operations of various parts in the exemplary clutch unit of FIG. 3.

Referring to FIG. 3 and FIG. 4, the clutch unit 300 may include a driving part 320 including a motor 310 electrically connected to the controller and configured to generate rotational force and/or power, a driving gear 312 connected to a shaft of the motor 310, driven gears 322 engaged with the driving gear 312, and a power transfer assembly 330 selectively connectable to the driving part 320 to transfer the rotational force from the driving part 320 to the main pulley 110 through the main belt 116 and/or to the sub pulley 210 through the sub belt 216.

While the embodiment shown in FIGS. 3-4 shows all parts including the motor 310 inside the clutch unit 300 (which may have a box-shaped case or housing), some of the parts, such as the motor 310, may be outside the case or housing of the clutch unit 300. In some cases, the case or housing of the clutch unit 300 may be omitted.

Some or all of the driving part 320 and generally the entire power transfer assembly 330 exist in two sets in the clutch unit 300. The two power transfer assemblies 330 may be respectively connected to the main pulley 110 and the sub pulley 210.

While specifically disclosed embodiment(s) include two drums in the washing machine, the present disclosure is not limited thereto, and three or more drums can be present. In such a case, each the number of (partial or whole) driving parts 320 and power transfer assemblies 330 in the clutch unit 300 may equal the number of drums.

The driving part 320 may include a driven shaft 324 connected to the driven gear 322, and a clutch cover 326 at an end of the driven shaft 324 (e.g., opposite to that of the gear 322).

As the shaft of the motor 310 rotates, the driving gear 312 rotates together, and as the driving gear 312 rotates, the driven gears 322 engaged with the driving gear 312 rotate together. In this regard, the driven gear 322 associated with the main pulley 110 and the driven gear 322 associated with the sub pulley 210 may engage with the driving gear 312, at different locations on the driving gear 312. Also, in such an embodiment, the driven gears 322 associated with the main pulley 110 and the sub pulley 210 may rotate is different rotational directions (e.g., clockwise vs. counterclockwise).

As the driven gear 322 rotates, the driven shaft 324 and the clutch cover 326 rotate together. The clutch cover 326 constitutes a clutch structure together with a clutch disc 331 of the power transfer assembly 330, and the clutch disc 331 is provided in a form engaged with the clutch cover 326. For example, each of the clutch cover 326 and the clutch disc 331 may comprise a disc having a plane perpendicular to the axis of the corresponding shaft, with a plurality of teeth extending from the disc. The teeth on one disc are configured to fit in or mate with openings or spaces between adjacent teeth on the other disc.

While the specifically disclosed embodiment(s) include the clutch cover 326 connected to the motor 310 and the clutch disc 331 connected to the power transfer assembly 330, it is also possible that the clutch disc 331 is connected to the driving part 320 or motor 310, and the clutch cover 326 is connected to the power transfer assembly 330.

When the clutch cover 326 is engaged with the clutch disc 331, the rotational force of the driven shaft 324 is transferred to the power transfer assembly 330, and when the clutch cover 326 is released from the clutch disc 331, the rotational force of the driven shaft 324 is not transferred to the power transfer assembly 330.

The power transfer assembly 330 may include a transfer shaft 332 connected to the clutch disc 331 to move the clutch disc 331 within a predetermined distance or translational range, a connector 333 connected to the transfer shaft 332 configured to allow the transfer shaft 332 to rotate, a cylinder 334 (e.g., including a piston) connected to the connector 333 to cause and reciprocate the translational movement of the connector 333, and an inner pulley 337 transferring power to the main pulley 116 (in one case) or the sub pulley 216 (in the other case).

The cylinder 334 is a general cylinder configured such that a piston or other mechanism therein causes and reciprocates movement along an axis, and may be or comprise, for example, a hydraulic cylinder. Alternatively, the cylinder 334 may be directly attached or fixed to (e.g., surrounding) the transfer shaft 332, in which case the connector 333 is not necessary. The cylinder 334 may be connected to a cylinder driving part 338 through a cylinder driving line 335. The cylinder driving part 338 is configured to control the movement of the piston of the cylinder 334, and when the cylinder 334 is or comprises a hydraulic cylinder, the cylinder driving part 338 may be configured to control the movement of the piston of the cylinder 335 by supplying or withdrawing working fluid thereto or therefrom. The cylinder driving part 338 is connected to the controller, which controls operations of the cylinder 334 according to a control signal (e.g., a drum selection signal) transmitted from the controller.

The connector 333 is connected to an end (e.g., of the piston or piston rod) of the cylinder 334, and moves in the moving direction of the piston as the piston reciprocates. The transfer shaft 332 is inserted into and/or through the connector 333, and the connector 333 and the transfer shaft 332 are connected to each other by one or more bearings (e.g., roller bearings, needle roller bearings, ball bearings in which the balls rotate or roll in a groove or slot in or on the transfer shaft, etc.). While the transfer shaft 332 rotates, the connector 333 does not rotate. However, as the connector 333 moved or translates, the transfer shaft 332 is also moves or translated by the connector 333.

As the transfer shaft 332 moves, the clutch disc 331 may be connected to (e.g., engage with) or released from (e.g., disengage from) the clutch cover 326. By controlling when the clutch disc 331 is connected to or engaged with the clutch cover 326, it is possible to selectively transfer the rotational force of the driven shaft 324 to the transfer shaft 332.

The inner pulley 337 is connected to a pulley shaft 336, and the pulley shaft 336 may have an end inside the transfer shaft 332. An inner clutch disc **336*a* is in or on the end of the pulley shaft 336 in the transfer shaft 332, and an inner clutch cover 332*a* is on an inner wall of the transfer shaft 332 (e.g., at an end opposite to the clutch disc 331), facing the inner clutch disc 336*a*. The inner clutch cover 332*a* is configured to mate or engage with the inner clutch disc 336*a***.

While the specifically described embodiments include the inner clutch disc **336*a* at the end of the pulley shaft 336, and the inner clutch cover 332*a* in the transfer shaft 332, it is possible that the inner clutch cover 332*a* is in or on the end of the pulley shaft 336, and the inner clutch disc 336*a* is in the transfer shaft 332**.

A distance that the piston of the cylinder 334 reciprocates is preset, and thus, a connection position where the clutch disc 331 connects to the clutch cover 326 and a maximum separation position by which the clutch disc 331 separates from the clutch cover 326 are set or predetermined.

Also, when the clutch disc 331 is at the connection position, the inner clutch disc **336*a* and the inner clutch cover 332*a* are connected, and when the clutch disc 331 is at the maximum separation position, the inner clutch disc 336*a* and the inner clutch cover 332*a*** are separated to the maximum extent.

Therefore, although the pulley shaft 336 does not move, since the transfer shaft 332 moves to connect the inner clutch disc **336*a* and the inner clutch cover 332*a*, the inner pulley 337 rotates at a fixed position. Since the inner pulley 337 rotates in place, the positions of the main belt 116 and the sub belt 216 do not change, and only the rotational force of the inner pulley 337** may be transferred to the main drum and the sub drum.

Now, operations and effects of the drum type washing machine 1 having the above configuration will be described.

In an initial state in which washing is not performed, the clutch disc 331 and the clutch cover 326 may be separated.

When a user uses or manipulates the control panel 16 in the initial state to select a washing operation in the drum type washing machine 1, a washing start command is transmitted to the controller connected to the control panel 16. The controller drives the motor 310 according to the received command and may transmit a control signal to the cylinder driving part 338.

At this time, the user may select either or both of the main tub 100 and the sub tub 200 to perform washing, so that a control signal is transmitted to the cylinder driving part 338 of the power transfer assembly 330 connected to the selected tub.

When the control signal is received by the cylinder driving part 338, the cylinder 334 is driven to move or position the clutch disc 331 at the connection position. At this time, since the motor 310 is in a driving state, the rotational force of the motor 310 is transferred to the driven gears 322 via the driving gear 312 to rotate the driving part 320, and when the clutch disc 331 is connected to the clutch cover 326, the rotational force of the driving part 320 is transferred to the drum inside the selected tub via the power transfer assembly 330. Thus, the drum inside the selected tub rotates to wash laundry therein.

According to the drum type washing machine 1 having the above described configurations, since two tubs each having a drum are in one washing machine to wash the first (main) laundry and the second (sub) laundry with separate drums, contamination of the second (sub) laundry with contaminants associated with the first (main) laundry can be avoided or prevented. In other words, contamination of baby clothes with contaminants in or associated with washing adult clothes can be avoided or prevented.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A drum type washing machine comprising:

a main tub having a main drum therein that rotates to wash main laundry;

a sub tub separate from the main tub and having a sub drum therein that rotates to wash separate laundry; and a clutch unit including a motor configured to provide a rotational force to both of the main drum and the sub drum, a driving part connected to the motor and a power transfer assembly connected to the driving part and selectively connectable to at least one of the main drum and the sub drum, wherein the power transfer assembly comprises:

a transfer shaft that is movable in a first direction approaching the driving part and in a second direction moving away from the driving part;

a pulley shaft selectively connectable to the transfer shaft;

an inner pulley connected to the pulley shaft and transferring rotation of the pulley shaft to one of the main drum and the sub drum; and a cylinder configured to move the transfer shaft in the first and second directions.

2. The drum type washing machine of claim 1, wherein when the power transfer assembly is connected to the driving part, the rotational force of the motor is transferred to the drum connected to the power transfer assembly.

3. The drum type washing machine of claim 1, wherein the driving part comprises a first driving part connected to the motor and a second driving part connected to the motor, and wherein the power transfer assembly comprises a first power transfer assembly connected to the main drum and selectively connectable to the first driving part and a second power transfer assembly connected to the sub drum and selectively connectable to the second driving part.

4. The drum type washing machine of claim 1, wherein the clutch unit comprises a clutch cover and a clutch disc configured to selectively engage with each other.

5. The drum type washing machine of claim 4, wherein one of the clutch cover and the clutch disc is fixed to the driving part, and the other of the clutch cover and the clutch disc is fixed to the power transfer assembly.

6. The drum type washing machine of claim 3, wherein the clutch unit further comprises a first clutch cover fixed to the first driving part, a first clutch disc fixed to the first power transfer assembly, a second clutch cover fixed to the second driving part, and a second clutch disc fixed to the second power transfer assembly.

7. The drum type washing machine of claim 1, wherein the power transfer assembly further comprises a connector connected to the transfer shaft and the cylinder.

8. The drum type washing machine of claim 7, wherein the connector transfers translational power from the cylinder to the transfer shaft, and allows rotation of the transfer shaft.

9. The drum type washing machine of claim 1, wherein the pulley shaft is connected to the transfer shaft when the transfer shaft is engaged with the driving part.

10. The drum type washing machine of claim 9, wherein the pulley shaft is disconnected from the transfer shaft when the transfer shaft is disengaged from the driving part.

11. The drum type washing machine of claim 1, wherein the inner pulley is at or proximate to an end of the pulley shaft opposite to the driving part.

* * * * *